US005109687A

United States Patent [19]

Ooba et al.

[11] Patent Number: 5,109,687

[45] Date of Patent: May 5, 1992

[54] DEVICE FOR ADJUSTMENT OF BARREL WIDTH OF ROLL TYPE STRAIGHTENER

[75] Inventors: Yasushi Ooba; Hiroshi Gotoh, both of Kitakyusyu, Japan

[73] Assignee: Nippon Steel Corporation, Tokyo, Japan

[21] Appl. No.: 726,570

[22] Filed: Jul. 8, 1991

[51] Int. Cl.[5] ..... B21B 31/08

[52] U.S. Cl. ..... 72/21; 72/224; 72/247; 72/239; 29/123; 29/125; 403/345

[58] Field of Search ..... 72/21, 199, 224, 237, 72/238, 239, 247, 251, 252.5; 29/110, 115, 116.1, 119, 123, 125, 129, 130; 192/18 R; 403/345, 355

[56] References Cited

U.S. PATENT DOCUMENTS

| | | | |
|---|---|---|---|
| 2,902,319 | 9/1959 | Mulder | 403/355 |
| 3,393,789 | 7/1968 | Keiter | 29/115 |
| 4,037,769 | 7/1977 | Meyers | 29/125 |
| 4,748,729 | 6/1988 | Rochelmeyer | 29/123 |
| 5,031,435 | 7/1991 | Seto et al. | 72/247 |

*Primary Examiner*—Lowell A. Larson
*Assistant Examiner*—Thomas C. Schoeffler
*Attorney, Agent, or Firm*—Kenyon & Kenyon

[57] ABSTRACT

In a roll type straightener, a barrel assembly including a pair of rolls (3, 3'), tightening male and female screws (5, 4), displacement male and female screws (14, 13) is mounted on a main shaft (8). The periphery of the respective female screws (4, 13) have a plurality of notches (22), with which pawls (**18*a*, 19*a*) of levers (18, 19) are engageable for preventing the female screws (4, 13) from rotation with the main shaft (8) by a drive source. Upon the adjustment of barrel width, the pawl is selectively engaged with the notch (22) of the tightening female screw (4) or both female screws (4, 13), so that the female screws drive the mating male screws (5, 14) in the axial direction to displace one of the rolls (3') to a predetermined position, as the main shaft (8) rotates. The operation sequence is controlled in a fully automatic manner by a controller (23) while monitoring the rotation of the main shaft (8) by a detector (20**).

7 Claims, 7 Drawing Sheets

Fig. 8(a)
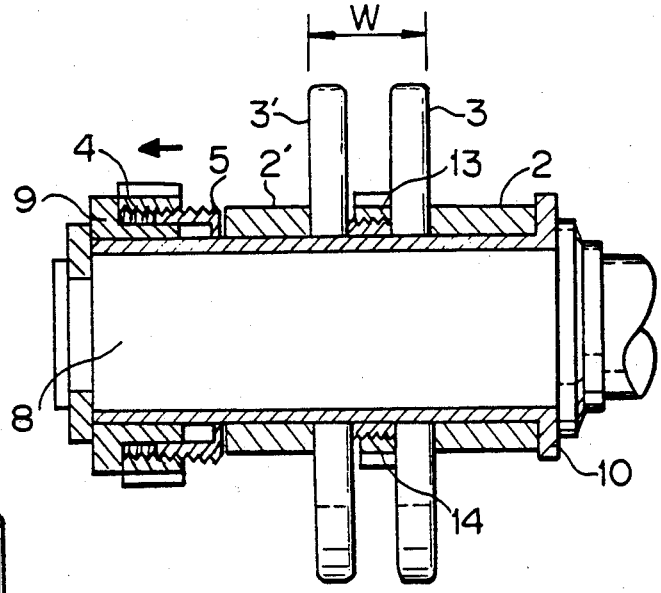
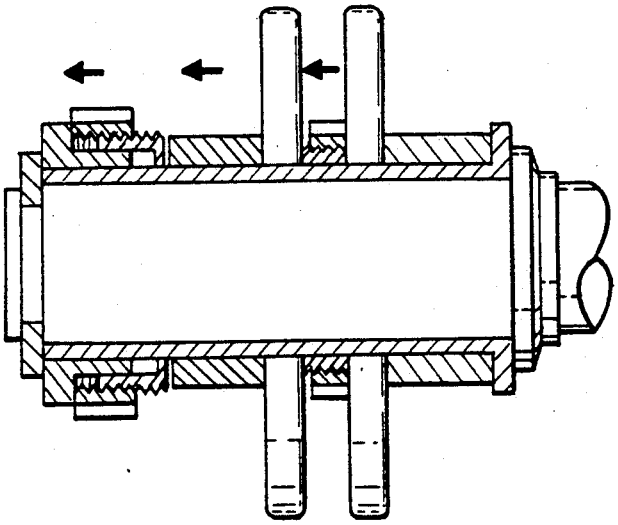
Fig. 8(b)
Fig. 8(c)
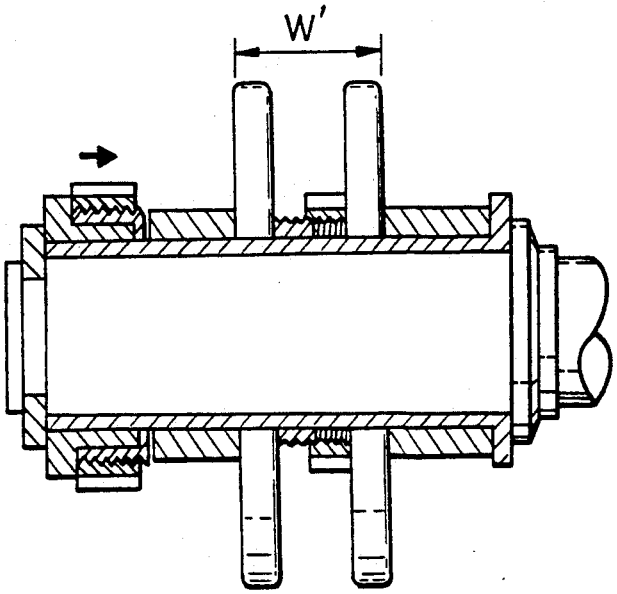

DEVICE FOR ADJUSTMENT OF BARREL WIDTH OF ROLL TYPE STRAIGHTENER

BACKGROUND OF THE INVENTION

1) Field of the Invention

The present invention relates to a device for automatically adjusting a space between a pair of rolls forming a barrel; namely, a barrel width of a roll type straightener for a rolled section steel combined with a roll mill line.

2) Description of the Related Arts

When straightening a section steel, such as a H-shaped section steel, the width of a barrel must be adjusted to correspond to the web height of the section steel, and usually the barrel assembly is formed by a pair of rolls mounted on a main shaft with a space therebetween.

In the prior art, an adjustment of the space between the pair of rolls forming a barrel assembly is carried out by a device comprising a pair of displacement male and female screws mounted at a region of a main shaft between two rolls, through a sleeve, and a pair of tightening male and female screws mounted at one end of the sleeve. The roll distance, i.e., a barrel width, is adjusted by loosening the tightening screws, adjusting the displacement screws to form a required distance between both the rolls, and thereafter, fastening the tightening screws to fix the rolls in position on the main shaft. These operations for displacing the screws are manually conducted on the respective shafts, and are time-consuming and cumbersome.

To avoid the lowering of the machine efficiency due to the adjustment of the barrel width, many sets of barrel assemblies may be prepared, the respective assembly in each set having been preset to a certain width different from that in the other sets.

Accordingly, when a change of barrel width is needed, a suitable set of barrel assemblies is selected and mounted onto the main shaft, in place of the original set. This lessens the machine stop time for changing the barrel width, because the barrel assembly replacement can be performed in a shorter time than that needed for the width adjustment stated above. Nevertheless, another problem arisens in this system. Namely, the recent tendency toward "small lot-multivariation" has had an influence even in the marketing of section steel, which now needs a higher number of barrel sets corresponding to the increased width variations. Accordingly, all of the barrel sets of various widths can not be stored in a stockyard, due to a lack of space, and in a worst case, a barrel set suitable for a section steel to be straightened may not be easily available. In such a case, a barrel assembly having the required width must be immediately prepared while stopping the machine. This, of course, lowers the machine efficiency. Alternatively, a straightening operation may be carried out without changing the barrel assembly or adjusting the width thereof, to avoid the lowering of machine efficiency, but this lowers the quality of the product.

The multivariation tendency in the section steel market is accelerated by technical developments in the production of an H-shaped section steel. Namely, the conventional H-shaped section steel delivered from a roll mill includes a steel having a constant inner width $H_i$, even though a flange thickness may be different, as shown in FIG. 5(*a*), and a barrel assembly with the same width can be used for straightening such group of section steel. Recently, another type of section steel having a constant outer width $H_0$ with various flange thicknesses, which is produced mainly by a weld-assembly method, can be produced from the roll mill (see FIG. 5(*b*)), and also requires a straightening operation, but to straighten these new type section steels, a barrel assembly having various widths must be used.

Under the circumstances, the adjustment of barrel width on a machine is again necessary, while using the identical barrel assembly mounted thereon so that a section steel such as H-shaped steel having various width sizes can be treated thereby.

In this connection, a mechanism has been proposed in Japanese Examined Utility Model Publication koku) No. 64-6982 to lessen the abovesaid laborsome operation, in which a displacement of barrel roll on a main shaft during the width adjusting operation is carried out by a power cylinder having a pawl engageable with notches on the periphery of a displacement female screw. Although a part of the manual operation can be done by the power cylinder, the loosening and fastening of tightening screws still must be manually performed by the use of a specially designed spanner and a hammer. Further, this adjusting operation must be carried out while repeatedly checking the barrel width by hand. Accordingly, this device still requires a considerable operation time and labor to adjust the barrel width.

SUMMARY OF THE INVENTION

An object of the present invention is to solve the above problems of the prior arts and provide an improved device for the automatic adjustment of barrel width of a roll type straightener for a section steel.

The object is achieved by a device for adjusting a barrel width in a straightener for a rolled section steel, according to the present invention, comprising a main shaft rotatable by a driving means; a pair of rolls forming a barrel fixedly mounted on the main shaft for rotation therewith, one of the rolls (fixed roll) being in a fixed position on the main shaft, while the other (adjustable roll) being adjustable in position along the main shaft so that a distance between the pair of rolls is variable; means arranged between the pair of rolls on the main shaft, for adjusting the position of the adjustable roll along the main shaft, comprising a pair of displacement male and female screws, the former being axially moveable but rotation-inhibitedly mounted on the main shaft and the latter being engaged with an outer thread of the former by an inner thread thereof and having a plurality notches on the periphery thereof, while the displacement male screw imparting an axial pressure onto the adjustable roll and the displacement female screw imparting an axial pressure onto the fixed roll; means for fastening the pair of rolls in position, comprising a pair of tightening male and female screws, the former being axially moveable but rotation-inhibitedly mounted on the main shaft and the latter being secured at a fixed position on the main shaft and engaged with an outer thread of the former by an inner thread thereof and having a plurality of notches on the periphery thereof, while the tightening male screw imparting an axial pressure onto the adjustable roll press same against the displacement male screw; means engageable with the notch of the displacement female screw for preventing a rotation thereof with the main shaft; means engageable with the notch of the tightening female screw for preventing a rotation thereof with the main shaft; and means for detecting the rotation of the main shaft.

Preferably, a device further comprises a controller for controlling a barrel width adjusting operation by a program memorized therein, while controlling a stop/-start of the main shaft and the action of said two means engageable with the notch with reference to a rotation signal from the rotation detecting means.

Preferably, the pair of rolls and said two male screws are mounted on a common sleeve to form a barrel assembly together with said two female screws; said sleeve being detachably mounted on the main shaft in an axially moveable but rotation-inhibited manner.

Preferably, a stop member is secured on the end portion of the main shaft for ensuring the fastening of the barrel assembly.

Preferably, at least one spacer is arranged on the sleeve between the selected screw and the selected roll.

Preferably, the main shaft is supported on a drive-side chock in a cantilever manner.

Preferably, said means engageable with the notch of each of the tightening and displacement female screws comprises a power cylinder and a pawl actuated by said cylinder to engage or disengage relative to the notch.

BRIEF DESCRIPTION OF THE DRAWINGS

The present invention will be explained in more detail with reference to the preferred embodiments illustrated in the drawings; wherein

FIGS. 8 (*a*), (*b*), (*c*) are an axial section of a barrel assembly, respectively, illustrating the basic steps of a barrel width adjustment.

DESCRIPTION OF THE PREFERRED EMBODIMENTS

Figure 6:
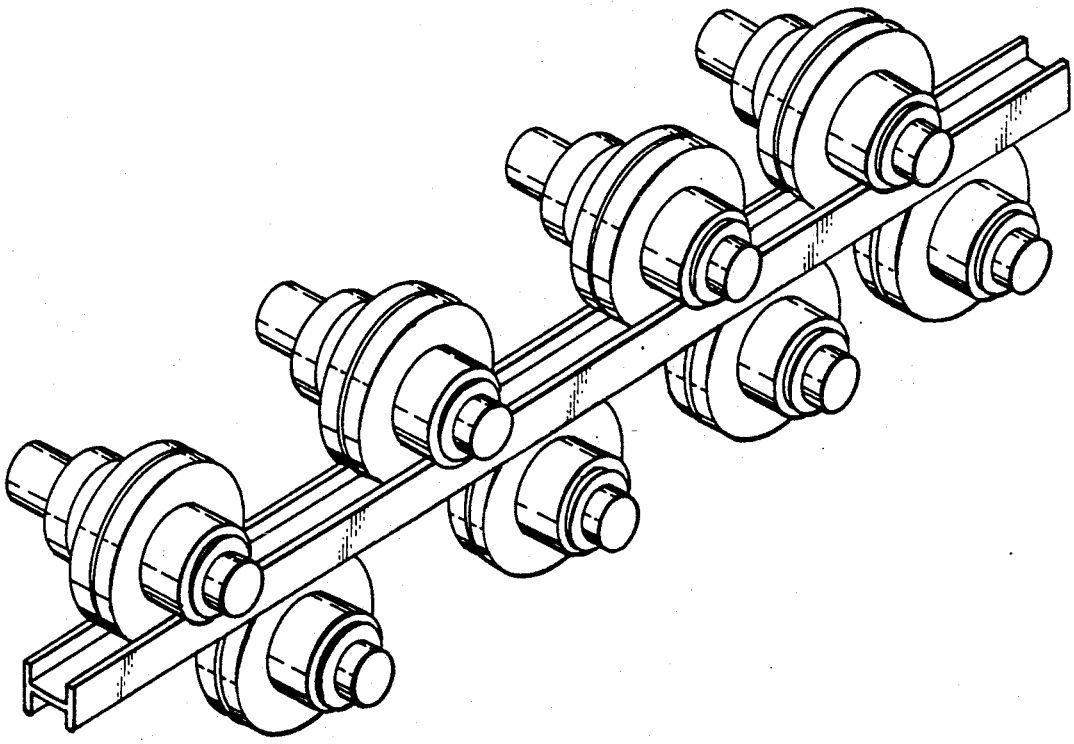
FIG. 6 is a perspective view of part of a straightener with upper barrels and lower barrels while intervening a H-shaped section steel therebetween.

In a straightener for correcting a bend of a H-shaped section steel delivered from a roll mill, as shown in FIG. 6 a plurality upper and lower barrel assemblies, each mounted on a main shaft are arranged in series while intervening a section steel to be straightened. The web of the section steel is pressed by the periphery of rolls forming the barrel while an inner width between side flanges thereof is defined by outer side surfaces of the respective rolls. This pressure of the barrel causes the section steel to bend in a lengthwise direction, and the bend is repeated alternately in the opposite direction by the adjacent upper and lower barrel, until it is gradually rectified to the straight state.

Figure 1:
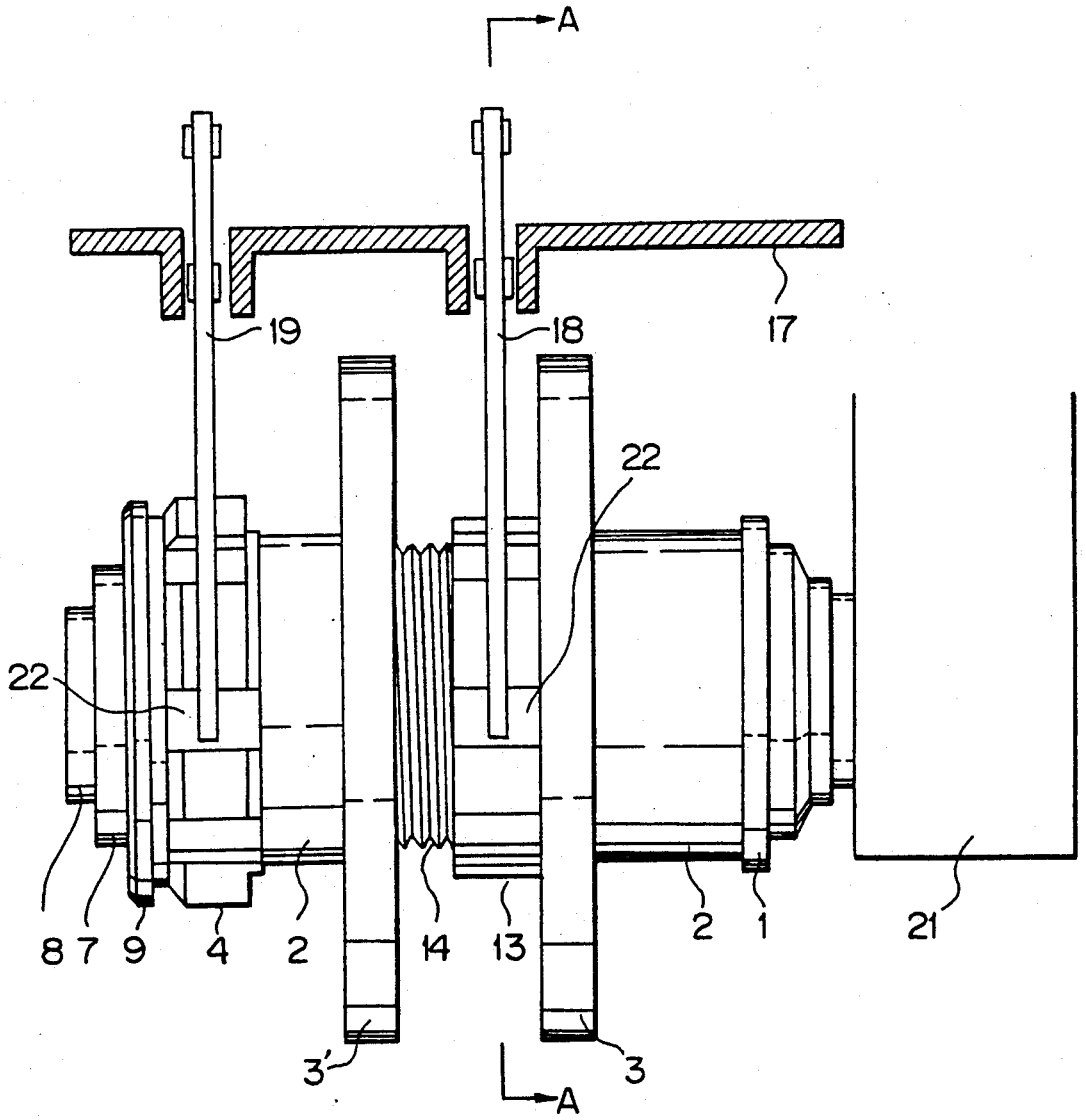
FIG. 1 is a frontal view of an upper barrel assembly of a straightener with a barrel width adjustment device according to the present invention.
Figure 2:
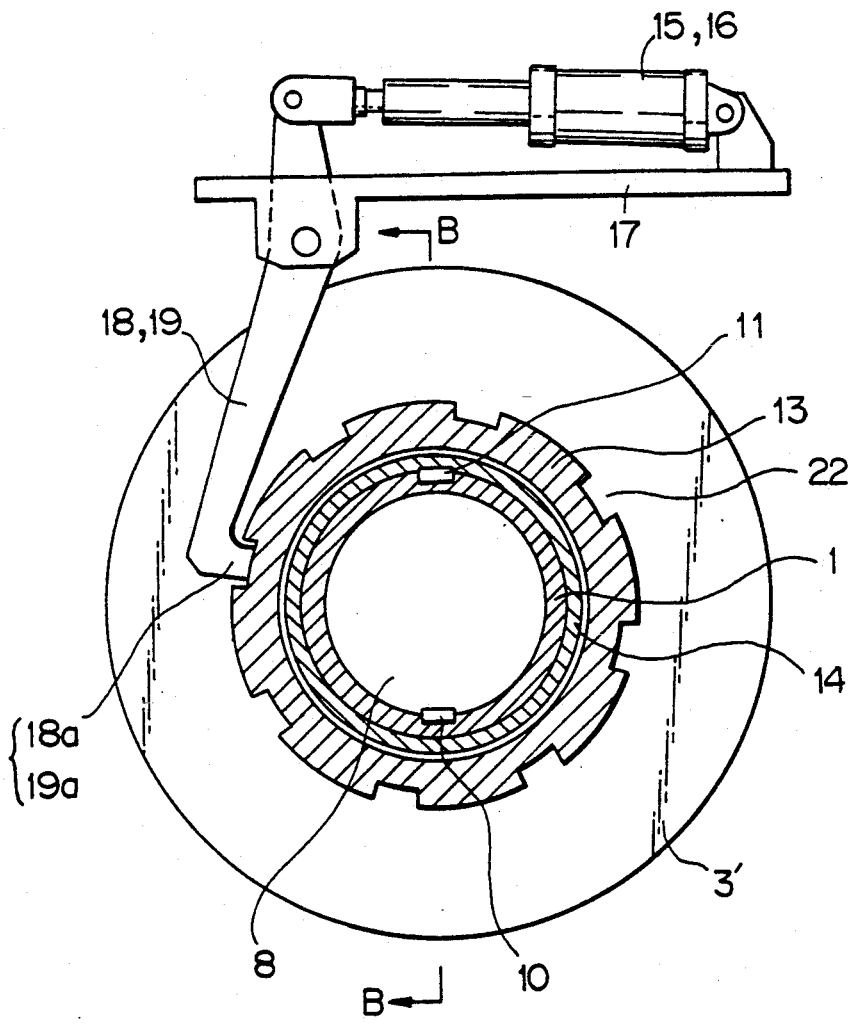
FIG. 2 is a cross-section of the barrel assembly
Figure 3:
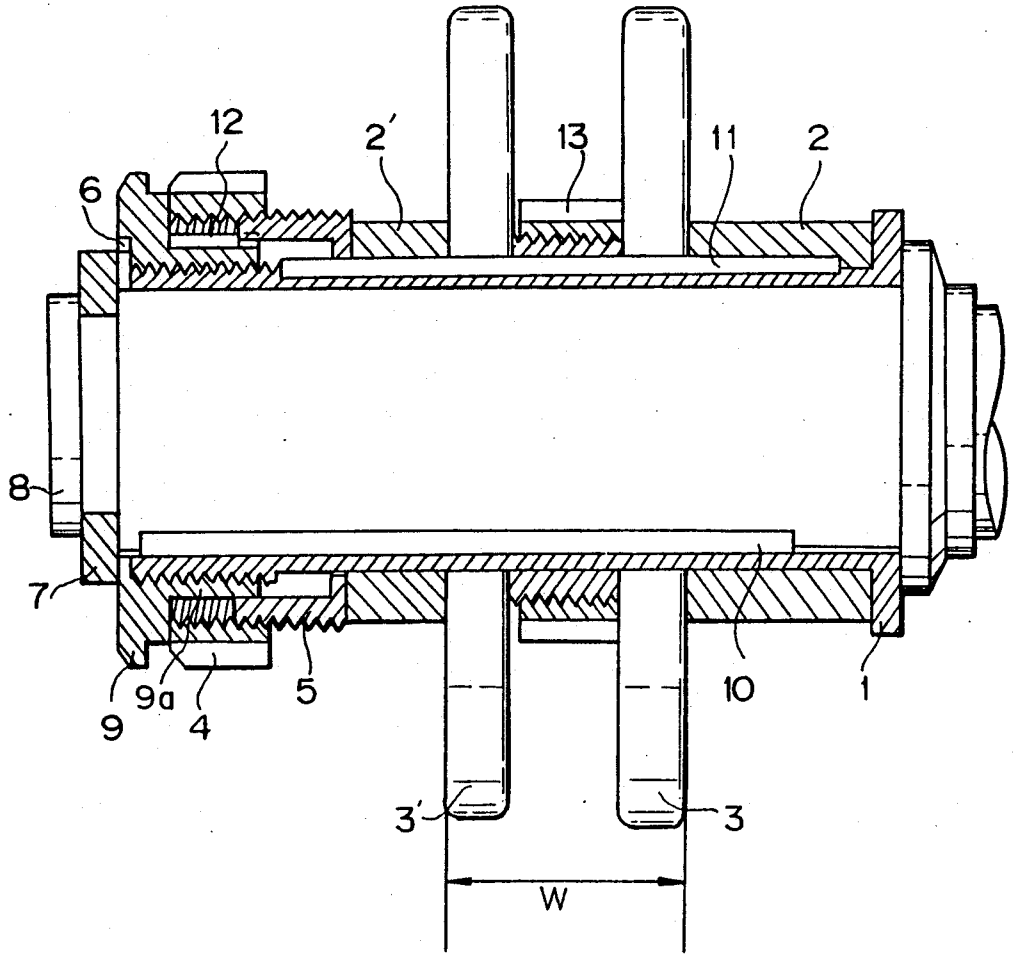
FIG. 3 is an axial section of the shaft portion of the barrel assembly taken along the line B—B of FIG. 2.

As illustrated in FIGS. 1, 2, and 3, the respective barrel assembly has a sleeve 1, on which a spacer 2 is mounted in a base end portion of the sleeve. A pair of 0 rolls, a fixed roll 3 and an adjustable roll 3' are also mounted, so that the fixed roll 3 is positioned adjacent to the spacer 2 while maintaining a predetermined distance from the base end of the sleeve 1. A displacement male screw 14 is mounted on the sleeve 1 in a portion between the pair of rolls 3, 3' while one end surface thereof abuts against the adjustable roll 3' Another spacer 2' is mounted on the sleeve 1 adjacent to the adjustable roll 3'. All of the spacers 2, 2', the pair of rolls 3, 3', and the displacement male screw 14 are secured on the sleeve 1 in a rotation-inhibited but axially slidable manner by a common slide key 11.

A stop member 9 is screwed with an outer end of the sleeve 1 and fastened at a fixed position while inhibited from both of axial slide and rotation by a stop key 6. Axially inward along the sleeve 1 extends a boss 9*a* of the stop member 9 on which a tightening male screw 5 is mounted in a rotation-inhibited but axially slidable manner by a slide key 12 at a position where the inner end of the tightening male screw 5 abuts against the outer end of the spacer 2' to press the same against the adjustable roll 3'.

A displacement female screw 13 is engaged with the outer thread of the displacement male screw 14 by the inner thread thereof. Similarly, a tightening female screw 4 is engaged with the outer thread of the tightening male screw 5 by the inner thread thereof. The displacement and tightening female screws 13, 4 have a plurality of notches 22 on the periphery thereof.

A barrel width is defined by an axial distance on this barrel assembly between the outer side surfaces of the rolls 3, 3'.

The barrel assembly thus constructed is mounted, as a single part, on a main shaft 8 in a rotation-inhibited manner by a slide key 10 and fixed in position by a fastening ring 7 secured at the end of the main shaft 8. Thus, if necessary, the replacement of the barrel assembly relative to the main shaft 8 can easily be carried out.

The main shaft 8 is supported on a drive-side chock 21 in a cantilever manner.

As shown in FIG. 2, a power cylinder 15 is provided on a frame 17 above the main shaft 8 at a position corresponding to the displacement female screw 13. To a tip end of a piston rod of the power cylinder 15 is connected a lever 18, a middle portion of which is pivoted on the frame 17 and a tip end of which has a pawl 18*a*. It will be apparent that, when the piston rod is in an extended state as shown in FIG. 2, the pawl 18*a* is engaged with the notch 22, and conversely when it is in a contracted state, the pawl 18*a* is disengaged therefrom by a pivot action of the lever 18.

A similar mechanism is provided regarding the tightening female screw 4, including a power cylinder 16, a lever 19 and a pawl 19*a*.

The principle of the operation of the above arrangement of the present invention will be described as follows with reference to FIGS. 8 (*a*), (*b*), and (*c*):

When the straightener is normally operated, the power cylinders 15, 16 are in a contracted state so that the levers 18, 19 do not interfere with the displacement and tightening female screws 13, 4. When the barrel width must be widened from W shown in FIG. 8 (*a*) to W' shown in FIG. 8 (*c*), the main shaft 8 is made to stop and the power cylinder 16 is actuated to engage the pawl 19*a* with the notch 22 of the tightening female screw 4. Then the main shaft 8 is made to rotate, while the tightening female screw 4 is caught by the pawl 19*a*, in a direction to slide the male screw 5 engaged therewith slightly away from the spacer 2'. (see FIG. 8 (*a*))

Then the main shaft 8 is to stopped. After the power cylinder 15 is actuated to engage the pawl 18*a* with the notch 22 of the displacement female screw 13, the main shaft 8 is again made to rotate. As thread pitches and spiral directions of displacement screws 13, 14 and tightening screws 4, 5 are designed to be equal to each other, both the female screws 4, 13 cause the mated male screws 5, 14 to slide in the same direction (lefthand in FIG. 8) and the same distance along the sleeve 1, as the main shaft 8 rotates while catching the female screws 4, 13 in a stationary state by the 18*a*, 19*a*.

The adjustable roll 3' sandwiched by the spacer 2' and the displacement male screw 14 also slides in the lefthand direction on the sleeve 1 together with the displacement of the male screws 5, 14. (see FIG. 8 (*b*))

After the roll 3' has reached the predetermined position at which a desired barrel width W' is attained, the main shaft 8 is made to stop and the power cylinder 16 resumes a retreated position to release the displacement female screw 13. Note the pawl 18*a* associated with the power cylinder 16 still catches the tightening female screw 4. The main shaft 8 makes an additional rotation, which causes the tightening female screw 4 to rotate on the male screw 5 so that latter is sufficiently pressed to the spacer 2' to firmly fasten the barrel assembly having a new barrel width onto the main shaft 8. (see FIG. 8 (*c*))

Thereafter, the main shaft 8 is made to stop and the power cylinder 16 releases the tightening female screw 4. Thus the adjustment of the barrel width is completed.

In the above description, the principle of barrel width adjustment has been explained in the widening operation. A narrowing operation is carried out in a similar way as above by reversing the rotational direction of the main shaft. A displacement of the screws or roll on the sleeve 1 is quantitatively estimated from the rotation of main shaft 8 measured by a detector 20 described later (see FIG. 4).

Figure 4:
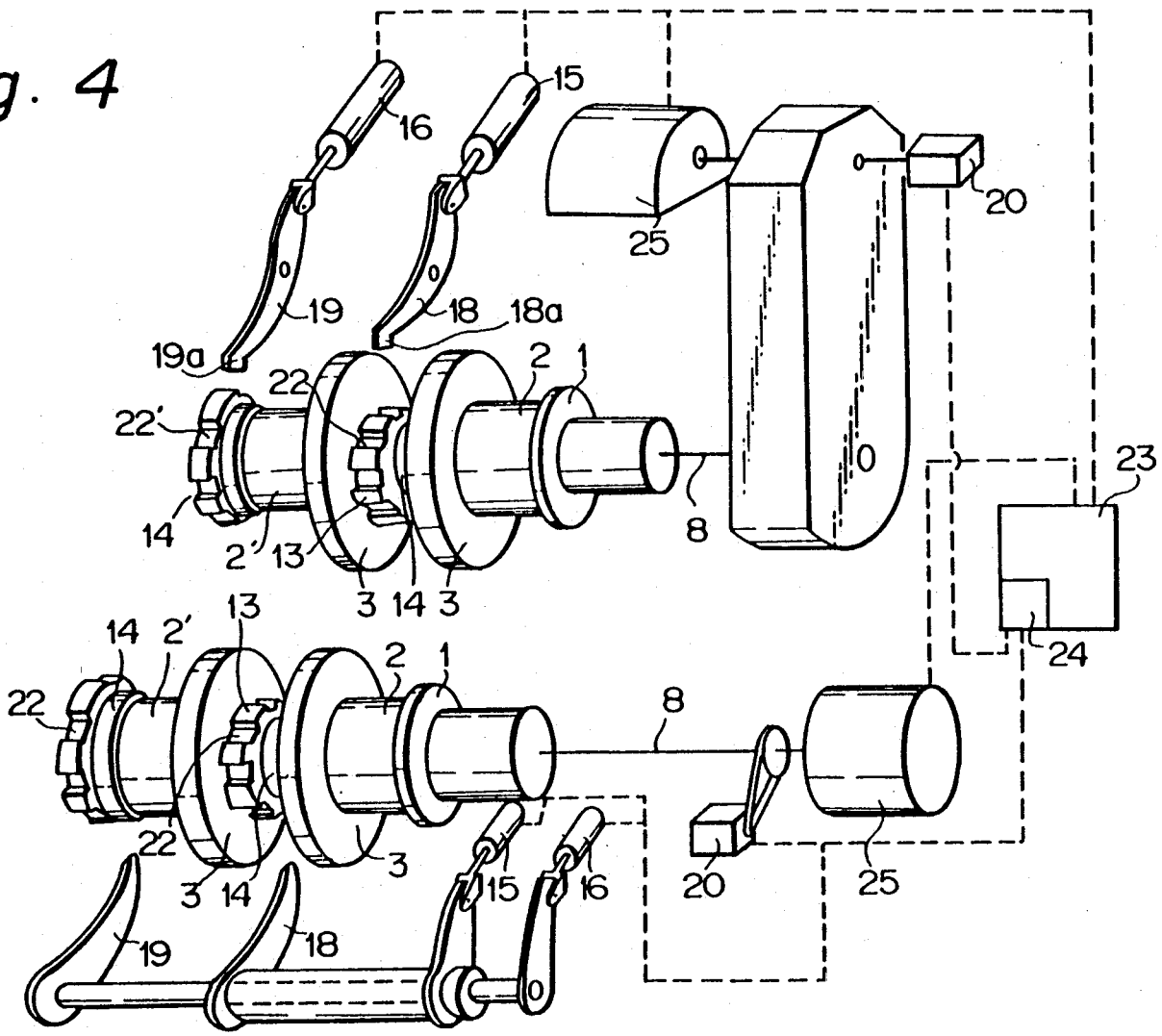
FIG. 4 is a schematic view of a total system for carrying out the barrel width adjustment operation according to the present invention.
Figure 5A:
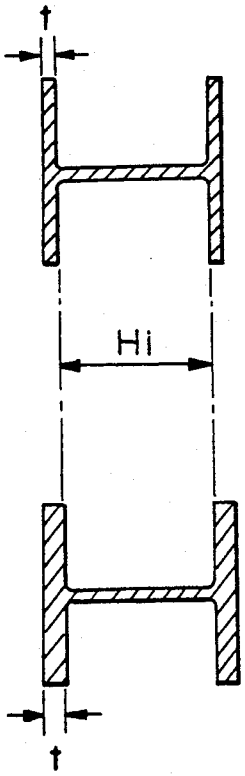
FIGS. 5(*a*) and (*b*) show two types of H-shaped section steel having a different dimensional relationship different from each other, respectively.
Figure 5B:
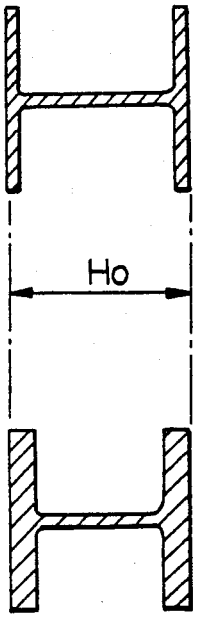

FIG. 4 diagrammatically illustrates a system for automatically carrying out the barrel width adjustment on all the barrel assemblies arranged in a straightener. Although only one barrel assembly is shown in the respective upper and lower rows in the drawing, there are actually many barrel assemblies arranged in series in upper and lower rows. In the lower rows, the power cylinders 15, 16 are positioned below the main shaft 8 and associated with the levers 18, 19 through a connecting means but the operation thereof is exactly the same as those of the upper rows described before.

The characteristic feature of the arrangement shown in FIG. 4 is a provision of a detector 20 for measuring the rotation of the respective main shafts 8. The detector 20 is connected to a processing circuit 24 in a controller 23 to input the information of the rotation of the main shaft 8 to the controller 23. The power cylinders 15, 16 and motors 25 for driving the respective main shafts 8 are also connected to the controller 23.

The operation of this system is as follows:

1. An aimed barrel width to be adjusted is decided and input to the controller 23. Then the controller 23 calculates a target value corresponding to a distance through which the displacement male screw 14 is to be travelled in the adjustment operation.

2. A start button is pushed to initiate the barrel width adjustment operation.

3. For the upper and lower rows of barrel assemblies, a full automatic adjustment operation is carried out as described before in accordance with a sequence program memorized in the controller 23.

4. A moving distance of the displacement male screw 14 in the adjustment operation is calculated in a real time manner in the processing circuit 24 by multiplying the main shaft rotation detected by the detector 20 by a thread pitch of the screw preliminarily memorized therein.

5. During the adjustment operation, stop/start of the motors 25 and actuation of the power cylinders 15, 16 is controlled by command signals issued from the controller 23 in accordance with the sequence program.

6. When the moving distance has reached the target value, the cylinder 15 releases the displacement female screw 13 to stop the movement of the male screw 14.

7. Thereafter, the automatic fastening of the tightening male screw 5 is carried out and the barrel width adjusting operation is completed.

According to this system, the barrel width adjustment can be performed in a fully automatic manner even by a remote control from an operating room without the continuous monitoring by the operator.

Figure 7:
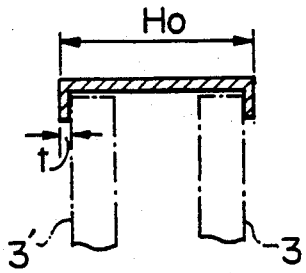
FIG. 7 is an axial section of a barrel assembly applied to a section steel other than one having a H-shaped cross-section.

Although the barrel assembly is fitted on the main shaft supported in a cantilever manner in the embodiments stated above, the barrel assembly according to the present invention is similarly applied to a main shaft supported on both sides thereof by a drive-side chock and a work-side chock. Further, the present invention is not limited to a straightening of H-shaped section steel but applied to other type section steels 26, such as shown in FIG. 7. Also in this case, various section steels having a constant web height $H_0$ but various flange thickness t are treated by the present invention.

The present invention has the following effects over the prior art:

1. In the prior art, several hours are necessary for adjusting the barrel width of all barrel assemblies forming a straightener. Conversely, according to the present invention, all the barrel assemblies can be simultaneously adjusted, whereby the time required for the adjustment of such as 100 mm distance is reduced to several minutes order. This improves the work efficiency of a production line.

2. An adjustment range is wider than that in the prior art.

3. In the prior art, the barrel width is manually checked during the adjustment operation by a steel scale or a slide caliper, with a rather low accuracy. Conversely, according to the present invention, the barrel width is accurately and automatically checked by the controller associated with the rotation detector, whereby the accuracy thereof reaches ±0.3 mm to the target value.

4. Even if a size of a section steel is changed, there is no need for the replacement of the barrel assembly, which the improves the workability.

5. While three or four persons are necessary for the barrel width adjustment in the prior art, a full automatization according to the present invention enables an unattended operation of the barrel width adjustment.

We claim:

1. A device for adjusting a barrel width of a barrel assembly in a straightener for a rolled section steel, comprising a main shaft rotatable by a driving means;

a pair of rolls forming a barrel fixedly mounted on the main shaft for rotation therewith, one of the rolls (fixed roll) being in a fixed position on the main shaft, while the other (adjustable roll) being adjustable in position along the main shaft so that a distance between the pair of rolls is variable;

means arranged between the pair of rolls on the main shaft, for adjusting the position of the adjustable roll along the main shaft, comprising a pair of displacement male and female screws, the former being axially moveable but rotation-inhibitedly mounted on the main shaft and the latter being engaged with an outer thread of the former by an inner thread thereof and having a plurality of notches on the periphery thereof, the displacement male screw imparting an axial pressure onto the adjustable roll and the displacement female screw imparting an axial pressure onto the fixed roll;

means for fastening the pair of rolls in position, comprising a pair of tightening male and female screws, the former being axially moveable but rotation-inhibitedly mounted on the main shaft and the latter being secured at a fixed position on the main shaft and engaged with an outer thread of the former by an inner thread thereof and having a plurality of notches on the periphery thereof, the tightening male screw imparting an axial pressure onto the adjustable roll to press it to the displacement male screw;

means engageable with the notches of the displacement female screw for preventing a rotation thereof with the main shaft;

means engageable with the notches of the tightening female screw for preventing a rotation thereof with the main shaft; and means for detecting the rotation of the main shaft.

2. A device for adjusting a barrel width as defined by claim 1, further comprising a controller for controlling a barrel width adjusting operation by a program memorized therein while controlling stop/start of the main shaft and action of said two means engageable with the notches with reference to a rotation signal from the rotation detecting means.

3. A device for adjusting a barrel width as defined by claim 1 or 2, wherein said pair of rolls and said two male screws are mounted on a common sleeve to form a barrel assembly together with said two female screws; said sleeve being detachably mounted on the main shaft in an axially moveable but rotation-inhibited manner.

4. A device for adjusting a barrel width as defined by claim 3, wherein a stop member is secured on an end portion of the main shaft for ensuring a fastening of the barrel assembly.

5. A device for adjusting a barrel width as defined by claim 3, wherein at least one spacer is arranged on the sleeve between a selected screw and the selected roll.

6. A device for adjusting a barrel width as defined by claim 1, wherein said main shaft is supported on a drive-side chock in a cantilever manner.

7. A device for adjusting a barrel width as defined by claim 1, wherein each of the tightening and displacement screws comprises a power cylinder and a pawl actuated by said cylinder to engage or disengage relative to the notches.

* * * * *